US008579293B1

(12) United States Patent
Sellers et al.

(10) Patent No.: US 8,579,293 B1
(45) Date of Patent: Nov. 12, 2013

(54) ANIMAL ROPING SYSTEM

(75) Inventors: Colter Sellers, Buffalo, WY (US); Casey Sellers, Buffalo, WY (US)

(73) Assignee: SS Roping, LLC, Buffalo, WY (US)

( * ) Notice: Subject to any disclaimer, the term of this patent is extended or adjusted under 35 U.S.C. 154(b) by 308 days.

(21) Appl. No.: 13/092,889

(22) Filed: Apr. 22, 2011

Related U.S. Application Data

(60) Provisional application No. 61/326,999, filed on Apr. 22, 2010.

(51) Int. Cl.
*A63B 69/00* (2006.01)
*A01K 15/02* (2006.01)

(52) U.S. Cl.
USPC ..... 273/359; 119/839

(58) Field of Classification Search
USPC ..... 273/338, 339; 119/839
See application file for complete search history.

(56) References Cited

U.S. PATENT DOCUMENTS

| | | | | | |
|---|---|---|---|---|---|
| 2,560,657 | A | | 7/1951 | Nogle | |
| 2,613,080 | A | * | 10/1952 | Dow | 273/383 |
| 2,846,810 | A | * | 8/1958 | Ory | 434/225 |
| 3,068,939 | A | | 12/1962 | Commisso | |
| 3,303,821 | A | | 2/1967 | Harris | |
| 3,711,098 | A | | 1/1973 | McCord | |
| 3,716,941 | A | | 2/1973 | Dowden | |
| 3,776,553 | A | * | 12/1973 | Kelton | 273/339 |
| 3,947,033 | A | | 3/1976 | Bennett | |
| 3,974,799 | A | | 8/1976 | Parsons | |
| 4,136,874 | A | * | 1/1979 | McCord | 273/339 |
| 4,203,233 | A | * | 5/1980 | Crane | 434/247 |
| 4,242,830 | A | | 1/1981 | Hauser | |
| 4,266,779 | A | * | 5/1981 | English | 119/839 |
| 4,268,037 | A | | 5/1981 | McKinley et al. | |
| 4,286,788 | A | | 9/1981 | Simington et al. | |
| 4,364,570 | A | | 12/1982 | Hallam | |
| 4,451,045 | A | * | 5/1984 | Fesmire | 273/338 |
| 4,498,676 | A | | 2/1985 | Runner | |
| 4,640,515 | A | * | 2/1987 | Rhine | 273/339 |
| 4,662,642 | A | * | 5/1987 | Archibald et al. | 273/339 |
| 4,714,445 | A | | 12/1987 | Templeton | |
| 4,816,000 | A | | 3/1989 | Hsu | |
| 4,874,179 | A | | 10/1989 | Henderson | |
| 4,981,302 | A | | 1/1991 | Narramore | |
| 4,995,618 | A | * | 2/1991 | Panzner | 273/367 |
| 5,009,432 | A | | 4/1991 | Richard | |
| 5,050,589 | A | | 9/1991 | Engle | |
| 5,050,598 | A | | 9/1991 | Tucker | |

(Continued)

OTHER PUBLICATIONS

U.S. Appl. No. 61/326,999, filed Apr. 22, 2010.

*Primary Examiner* — Raleigh W Chiu
(74) *Attorney, Agent, or Firm* — Santangelo Law Offices, P.C.

(57) ABSTRACT

The current inventive technology is generally directed to an improved animal roping form representing an improved training system applicable to various animal roping activities. Some embodiments of the inventive technology may include, for example, an animal form (2), a tractable leg element (3), a joint element (4) and a resilient torsion control joint connection (5) that may facilitate the tension coupling of the leg element (s0 to said animal form to more realistically mimic a live animal movement and resistance. In addition, some embodiments may include support attachment element (6) coordinated with a support element (8) allowing, for example such animal form to be suspended or conveyed to approximate animal movement to create a realistic roping training system. Further embodiments may have a knee joint (16) to more fully replicate the anatomical movements of a real animal leg joint.

23 Claims, 16 Drawing Sheets

(56) References Cited

U.S. PATENT DOCUMENTS

| | | | | |
|---|---|---|---|---|
| 5,080,373 | A | 1/1992 | Jones | |
| 5,286,032 | A | 2/1994 | Spencer | |
| 5,568,926 | A | 10/1996 | Kaptein | |
| 5,709,386 | A * | 1/1998 | Nelson | 273/370 |
| 5,775,698 | A | 7/1998 | Jones | |
| 6,497,411 | B1 | 12/2002 | Nelson | |
| 6,629,695 | B2 | 10/2003 | Tisdell | |
| 6,736,399 | B1 * | 5/2004 | Copenhaver | 273/339 |
| 6,763,650 | B1 | 7/2004 | Snow | |
| 6,945,534 | B1 | 9/2005 | Lindsey | |
| 7,059,605 | B1 * | 6/2006 | Hughes | 273/369 |
| 7,293,775 | B1 * | 11/2007 | Donnelly et al. | 273/359 |
| D574,897 | S | 8/2008 | Boyle | |
| 2003/0034613 | A1 | 2/2003 | Tisdell | |
| 2005/0282128 | A1 | 12/2005 | Brinkerhoff | |
| 2006/0170163 | A1 | 8/2006 | Perkins | |
| 2007/0017456 | A1 | 1/2007 | Huett | |
| 2009/0014960 | A1 | 1/2009 | Brackens | |
| 2009/0189352 | A1 | 7/2009 | Kemp | |

* cited by examiner

ANIMAL ROPING SYSTEM

This application claims the benefit of and priority to U.S. Provisional Application No. 61/326,999, filed on Apr. 22, 2010. The entire specification and figures of the above-mentioned application is hereby incorporated, in its entirety by reference.

TECHNICAL FIELD

The present inventive technology is directed to new and novel apparatus and methods for an improved animal roping system. Generally, the above referenced improved system may incorporate novel tension coupling techniques and devices as well as materials and configurations to more approximate the anatomical and physical characteristics of a live animal. As such, the current inventive technology represents an improved roping training system incorporating the following novel improvements that overcome the deficiencies in prior animal roping systems. In some embodiments, the current inventive technology may be used to train horse and roper in for example calf roping, flanking, stringing, gathering, and tying for rodeo in calf roping or goat-tying events and the like.

BACKGROUND

Rodeo style roping and animal events are a hallmark of American and Western culture. As the popularity and number of participants of these events has increased there has arisen a need to develop training systems where participants may practice these often dangerous events in a safe and controlled environment. The current inventive technology addresses this long felt need and may comprise, in some embodiments methods and apparatus for an improved animal roping system which may act as a training device and/or system for practicing roping, flanking, gathering, and tying as well as tie-downs, breakaways or other animal tying rodeo events on an animal form, such as a calf or goat that represents an improved realistic shape, size and feel of a real animal. The current invention may be adapted to a variety of users as well as animal forms. In some embodiments such inventive improvements may include a more realistic animal roping animal form which may be used to simulate roping a live animal and may further be used to practice roping and/or other techniques in a controlled and safe environment. This is especially helpful and important for younger participants that are in the early stages of learning these roping and tying type events. The current inventive technology may assist a user in increasing their speed in tying a calf or goat as would occur in a calf-roping, goat-tying or breakaway roping competition in rodeos and the like. Further embodiments of the current inventive technology may allow for a more precise roping simulation further aiding the user in becoming more efficient at roping various live and/or simulated animals.

In the current inventive technology, such an improved animal roping system (1) may include for example an animal form (2), at least one tractable leg element (3), at least one joint element (4), at least one resilient torsion control joint connection (5) which may be articulated in such a manner so as to be tension coupled allowing for tractable individual elements that more replicate the movement and resistances displayed in a live animal. In additional embodiments as will be detailed below, such animal form may be mounted on a support element (8) through, for example a support attachment element (6) and either be maintained in a stationary position or perhaps conveyed though a plurality of mechanisms. As such, this improved animal roping system (1) may be used for: 1) rating your horse with the animal form (2); 2) roping a animal form (2) off the horse; 3) getting off your horse with the animal form (2) attached to your rope which may be tied unto the saddle horn; and 4) flanking, stringing, gathering, and tying in for example calf roping or goat-tying events. In addition the current inventive technology may allow for a user to mimic the various actions of starting in the box to crawling back on the horse after the animal form (2), such as a calf is tied. The current invention may act as a training tool allowing a user to practice realistic training such as roping and tying a calf down in a controlled environment. In additional embodiments a user may use a break-away rope which may mimic the actions of roping an animal up to the point of getting off the horse and tying the calf or other animal.

The current inventive technology may have numerous objectives that address and solve long felt needs within the industry and represent an inventive leap forward in the field of animal roping systems. Generally the state of the art is deficient due to the lack of innovation as well as construction and materials used. Generally available animal roping forms are unable to mimic life-like movements and feel of real animals common to rodeo roping activities and as such are limited in their ability to provide realistic training opportunities. Many are simple frame structures or non-articulated animal forms that cannot be manipulated to accurately replicate life-like animal movements and resistances. Many use rudimentary materials that are overly-rigid and do not replicate the pliable feel of a live roping animal. In addition many use inadequate materials that easily wear out and cannot be easily detached and/or replaced. These deficiencies are especially limiting as such animal roping systems are subjected to extreme torsional and frictional forces during practice sessions as well as harsh exposures to extreme cold and heat as well as dirt and moisture. As such, the current inventive technology may incorporate such improvements herein described making the current inventive technology superior to known prior art. Objectives of the current technology in some embodiments may include but are not be limited to:

- Providing an animal form that may be tension coupled such that said individual articulating elements may be tractable so as to more fully replicate the feel and resistances of real roping animals.
- Providing a animal form of such construction that it may represent a realistic representation of a live calf or other animal form and its use greatly improves and speeds up the calf-roping ability of a person practicing for rodeo competition.
- Form and mount for example tractable leg elements such that for example rear legs may be swung forwardly from hip portions and the front legs bent rearwardly at their shoulders and knees and the front and rear legs then tied in overlapping relation to each other.
- Provide a more realistic dummy calf having a body and legs formed of molded flexi foam rubber, the legs being tension coupled, which may allow the legs to be manipulated in the usual manner and front and rear legs tied together.
- Provide a dummy form in the shape of for example a calf or goat which is approximately the size of animals used in calf-roping contests and so constructed that it may be thrown from a standing position onto its side and its legs tied in the same manner that the legs of a live calf's and/or goat's are tied in competition.
- Provide a support element that may carry such a realistic animal form in the position and height as a live animal such as a calf. Such a support element may emulate for example a full calf run starting in the roping box in the arena on horseback, getting your horse to rate behind the calf in an optimal position to rope such a calf, swing and catch the calf, allowing the calf to stop and pop off the support element allowing the roper to get off the horse, go down the rope and flank and tie the animal form.

Assist in training a horse for example to hold a calf rope tight as in a live calf roping event to help flank a calf and prevent the calf from getting up or kicking while tying the legs.

Further objects of the current inventive technology will be discussed directly and will also be inherently disclosed or made obvious in this application.

SUMMARY OF THE INVENTION(S)

The current inventive technology generally describes an improved animal roping form or "roping dummy" that more fully replicates live animal roping and tying. Such an invention may be especially applicable as a practice and/or training apparatus so as to reduce risk of injury to both roper and animal as well as allow for training sessions at a users convenience. As such, embodiments of this invention may provide a life-like animal form for assisting a user in practicing for tie-down, roping or goat-tying or other rodeo type events. This animal form may replace live calves, goats or other animals allowing ropers to practice indoor or outdoors. Importantly, the inventive technology may comprise a training system or kit that may be used to train both horse and roper. It allows a user to practice slowly in a controlled atmosphere for both horse and roper. The inventive technology teaches the basics of each step in the roping and tying process at a regulated speed. The entire assembly is easy to put-together and may have detachable and/or replaceable parts as needed. The invention as a whole is safe, durable and long lasting as well. The current inventive technology takes advantage of several novel and unique mechanical advancements, methods of manufacture as well as materials used to better approximate the movements and resistances found in live roping animals such as a calves and/or goat. Such improved approximation may be achieved through the novel tension coupling aspects as well as other improvements as herein discussed.

DETAILED DESCRIPTION OF THE PREFERRED EMBODIMENT(S)

Figure 1:
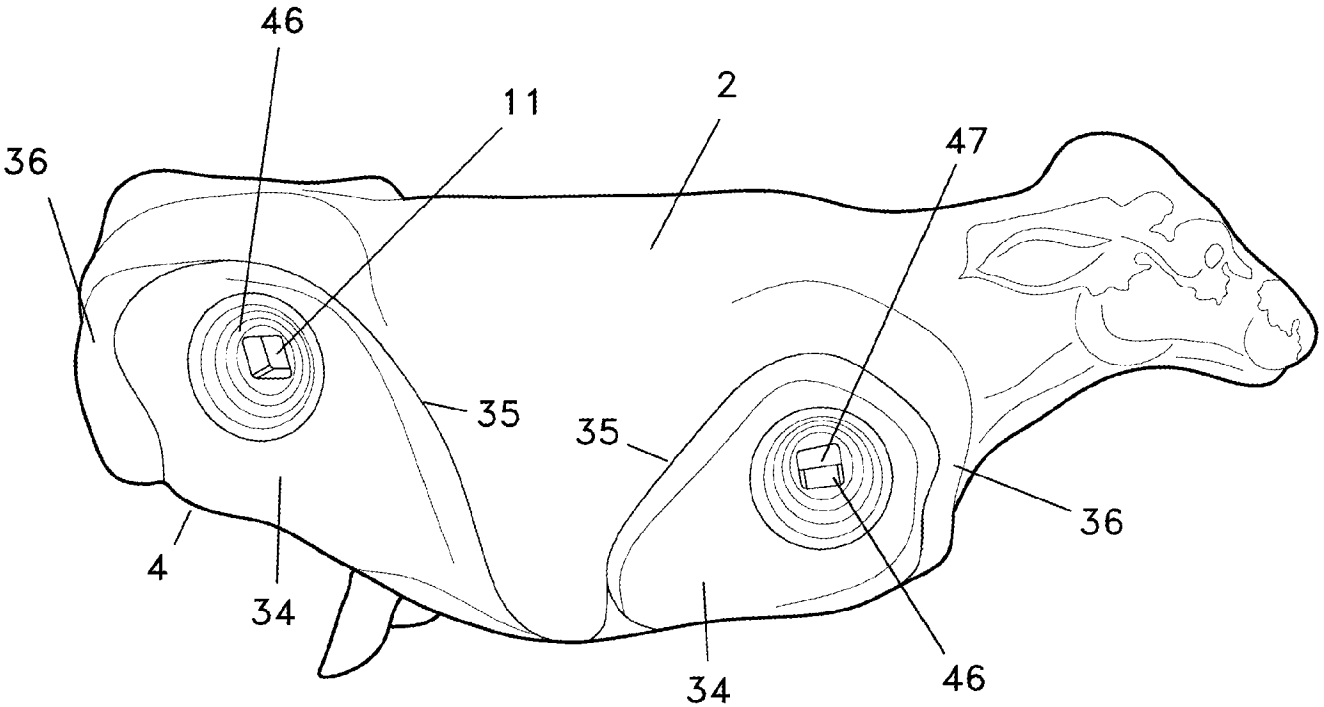
FIG. 1—is a right side-view of an animal form in one embodiment.

The present inventive technology includes a variety of aspects, which may be combined in different ways. The following descriptions are provided to list elements and describe some of the embodiments of the present inventive technology. These elements are listed with initial embodiments, however it should be understood that they may be combined in any manner and in any number to create additional embodiments. The variously described examples and preferred embodiments should not be construed to limit the present inventive technology to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

The current inventive technology in a preferred embodiment generally describes an improved animal roping system (1) which may further comprise an animal form (2), at least one tractable leg element (3), at least one joint element (4) and at least one resilient torsion control joint connection (5). In one such embodiment, such elements may be tension coupled through operation of said resilient torsion control joint connection (5).

As generally referenced in FIGS. 1-11, in one embodiment, such an improved animal roping system may be formed for example by the steps of forming at least one animal form integrating (or coupling) at least one joint element containing at least one internal joint aperture spanning said animal form and forming at least one tractable leg element integrating at least one joint element containing at least one internal joint aperture. Such step for forming may include molding and/or casting using, for example, injectable molding techniques known in other fields, using, for example, urethane expanding flexible foam, a plastic(s), a composite material(s), foam, poly-urethane, a flexi-foam rubber, a rubber, and injection molding materials and the like as could be appreciated by one skill in the art. However, such methods of forming are not considered limited and other techniques such as pressing, carving, shaping as well as other construction techniques are contemplated.

As such, the step of inserting at least one resilient torsion control joint connection (5) through said internal aperture spanning said animal form may be accomplished. Such a joint aperture (47) can be generally seen in FIG. 1 and may span the internal length of the animal form (20). In addition, such joint aperture (47) may be external, or may not span the entire animal form (2). In still further embodiments, such joint aperture (47) may be formed by the coupling of, for example, a plurality of joint element (4) integrated into said animal form (2) perhaps by molding them into place providing a continuous and covered joint aperture (47) being internally positioned.

Further, in a preferred embodiment the inventive technology contemplates tension coupling a plurality of leg elements with said animal form by extending the distal ends of said resilient torsion control joint connection (5) through the internal joint aperture (47) on, for example, said joint element of said tractable leg elements (44) approximately beyond at least one inverted extension barrier (48). Additional steps may include, as referenced in FIG. 11, for example, securing at least one tension lock washer (66), which in one embodiment may include a plurality of shaped split washers (67), around said resilient torsion control joint connection (5), followed by the step of releasing said extended resilient torsion control joint connection (5) such that said tension lock washer(s) (66) is fitted in at least one resilient torsion control joint connection tension coupling slot (50) securing said system. Such lock washer (66) may be fitted to said distal resilient torsion control joint projection (61), perhaps proximally. Such lock washer (66) may provide a durable surface so as to aid in the tension securing of the aforementioned elements through operation of the resilient torsion control joint connection (5). In addition, such lock washer (66) may prevent tearing, or cutting forced as well as wear and tear by acting as a physical buffer and/or barrier between said resilient torsion control joint connection(s) (5) and said joint elements (4), inverted extension barrier (48) and/or tension coupling slot (50). As such it may be desired that such lock washer (66) may be fabricated of a harder material that said resilient torsion control joint connection (5). In a preferred embodiment, such material may have a higher resistance to torsion forces. It should be noted that such elements can be easily removed to be adjusted, cleaned and/or replaced.

Figure 4:
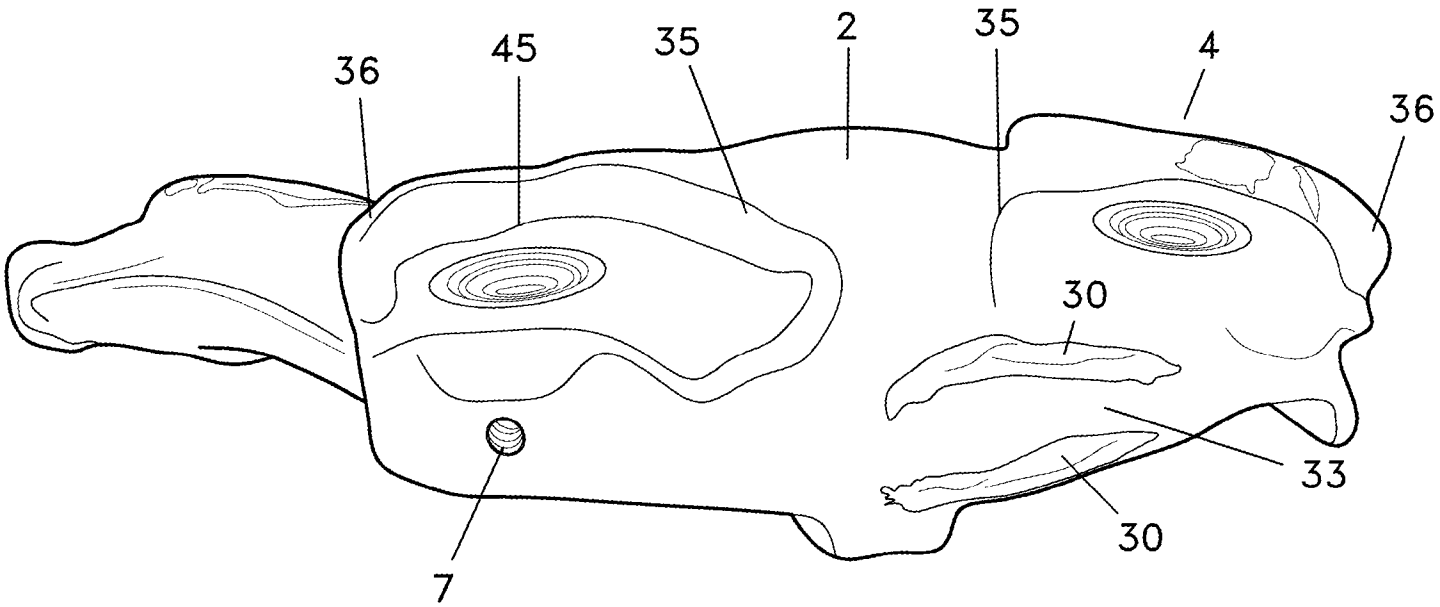
FIG. 4—is a posterior view of an animal form in one embodiment.

As generally referenced in FIGS. 1 and 4, in one embodiment of the inventive technology, the main body of the animal form (2) may include a full-scale replica of an anatomically accurate calf, including musculature and surface features. Further embodiments may include scaled down (or up) versions of various animal forms (2) more suitable for perhaps young children, teenagers and/or adults. As previously discussed, such an animal form (2) may include a calf form; a goat form; a steer form; a lamb form; and a sheep form. In addition, abstract forms may also be contemplated as well as various game and/or domesticated animals, such as dogs, cats, horses, elk, sheep, moose and the like. The animal form (2) may be created from various materials with mechanical/articulating connections and/or joint elements (4) internally positioned for different realistic movements and tensions. In a preferred embodiment, such an animal form may be molded utilizing a urethane expanding flexible foam animal form. Additional embodiments may include a plastic animal form, a composite material animal form, a foam animal form; a poly-urethane animal form; a flexi-foam rubber animal form; a rubber animal form; and an injection molded animal form and the like.

As seen in FIG. 1, in such a exemplary calf embodiment, the animal form (2) may be designed with an anatomically accurate head, positioned at an angle to run with its head running flat or down slightly, to overemphasize getting a user's tip of the rope down when swinging and throwing to get a good figure eight in the rope loop, preventing the calf from running through the loop, avoiding a no-time in rodeo events.

As mentioned previously, the calf form may be made from softer materials which may give the animal form (2) a softer more realistic feel of for example a calf body. During certain tying actions, a user may actually kneel or knee into the animal form (2) while flanking and sitting on the calf. Such malleability allows for a more accurate representation leading to an enhanced and more realistic training experience. Further, in some embodiments, the main part of the body has some flexibility to bend or arch as rear legs are scooped up and brought forward to gather with the front leg as in a real and natural calf. The body has a realistic soft chest to allow the knee of the roper to practice proper blocking when attempting to throw the calf. Further embodiments, may include only certain elements being made of a specific customized material. In one example a tractable leg element (3) may be made of one material while the main body of the animal form may be made of a different material having a separate characteristic profile such as hardness, tension resistance, cost and the like. As such, this improved animal roping system (1) may be customized according to a user's desired characteristics and or cost.

In some embodiments the front and rear legs are scaled and appear anatomically correct. In the calf animal form embodiment generally shown in FIGS. 1-20, for example the invention may have hair-like appearance and feel, dew claws and split hooves, as these are things that ropers tend to get hung up on when tying three legs in a gather under timed conditions. As such softer materials provide the feel and grip of a real animal enhancing the training experience. An additional benefit of the unique design and materials include the feature that, when wrapping the legs with a pigging string the legs are soft, avoiding any bruising or cuts on hands as well as to replicate how, for example a real calf might feel and or react to being tied in this manner. In other embodiments of the current inventive technology the angle of the form head, in this instance a calf head is positioned at an angle such that that it emphasizes to the roper to get its tip down on the rope, as to avoid catching the top of the head or horns which may be detachable (37), or integral as part of the animal form for example in a steer embodiment. The shape and color of the calf are substantially lifelike to help create a strong mental imaging for the horse aiding in the training experience. As discussed, the softer material, as opposed to such traditional calf roping dummies, provides a realistic mold of a real life-sized calf or other animal that has a soft texture of skin and body to allow the rope to lay with more of a natural action around the neck and reducing the "bouncy" aspect when using such traditional plastic surfaces which is unnatural. Additionally, one may also rope the animal form free standing, or tied to the chute without a support attachment element (6) for additional repetitive flank, gather and tie practice. As a result of these novel advancements in materials and design features, a roper's hands are gripping something that would imitate a real calf further enhancing the inventions practicality and usefulness.

Certain embodiments as shown in the FIG. 4 may include a flank handle (30) on said animal form (2) which may provide a simulated position for a user to grab the flank muscle and skin, to resemble the flanking of, in this example a real calf, and to remind the roper to use proper form when grappling and flanking the animal for example with one hand on the rope in front of the calf's head and other hand on the flank of the calf and a knee into the soft body to throw down a calf to tie. Such a flank handle (30) may be reinforced and/or customized as to depth, length as well as right or left hand side according to a user's desire. Some embodiments may include an integral flank handle (31); such that it is molded as part of the animal form on the posterior rear aspect of in this case a calf. In addition, additional aspects of the current invention may include at least one approximately planar lateral side (32) such that the body is slightly flattened on one side (the side that can optimally be thrown and laid down on the ground side) to provide a more flat and sturdy surface. Such an approximately planar lateral side (32) may be customized as to the right or left hand side according to a user's desire (or handedness).

Again referring to FIG. 4, certain embodiments may include a narrowed posterior aspect (33) on said animal form (2). Such a posterior aspect (33) may accommodate the in-line sliding and lateral movement of said tractable leg elements (3) as they are brought inward and gathered for example. In addition, as shown in FIGS. 1 and 4, the inventive technology may include, in certain embodiments planar tractable leg element slide position(s) (34) on said animal form. Such planar positions may again be integral to said animal form (2) and may provide a planar surface to accommodate the inline-slide movement of the tractable leg element(s) as they are brought inward or gathered by the user perhaps. In other embodiments such slide position(s) may include medially sloping planar tractable leg element slide position(s) (35). Such medially angled slide positions may define a raised edge along an angled path to provide a boundary position to stop the inward movement of said tractable leg element (3) past a desired point. Also shown in FIGS. 1 and 4, it may be desired to provide a raised mechanical stop to prevent the in-line movement of the legs in an outward direction along the axis of a resilient torsion control joint connection (5). Certain embodiments may include an integral outward directional axis movement stop (36). Such integral outward directional axis movement stop (36) may define a raised edge to provide a boundary position to stop the outward movement of said tractable leg element (3) past a desired point. As shown in FIGS. 1 and 4, when utilized in conjunction, such planar tractable leg element slide position(s) (34), medially sloping planar tractable leg element slide position(s) (35), and integral outward directional axis movement stop (36) may provide a boundary to prevent undesired rotation along the axis of a resilient torsion control joint connection (5). Such element may also be customized as to direction, size, depth, slope as well as shape and the like.

As generally indicated in FIG. 4, in certain embodiments an animal form (2) may be detachably mounted onto a support element (8). Such a support element (8) may be coupled to said animal form (2) through, for example, support attachment element (6). Such an attachment may include in some embodiment of an external support or carrier or shaped support. Certain embodiments may include, for example, a stationary support element (9) (not shown) which may include a weighted base coupled with the posterior aspect of said animal form (2), and/or suspension supporting, perhaps in an adjustable manner said animal form (2) at a desired height. In other embodiments such a stationary support element (9) may be stabilized with a wide base, or other locking or stabilizing elements.

Figure 16:
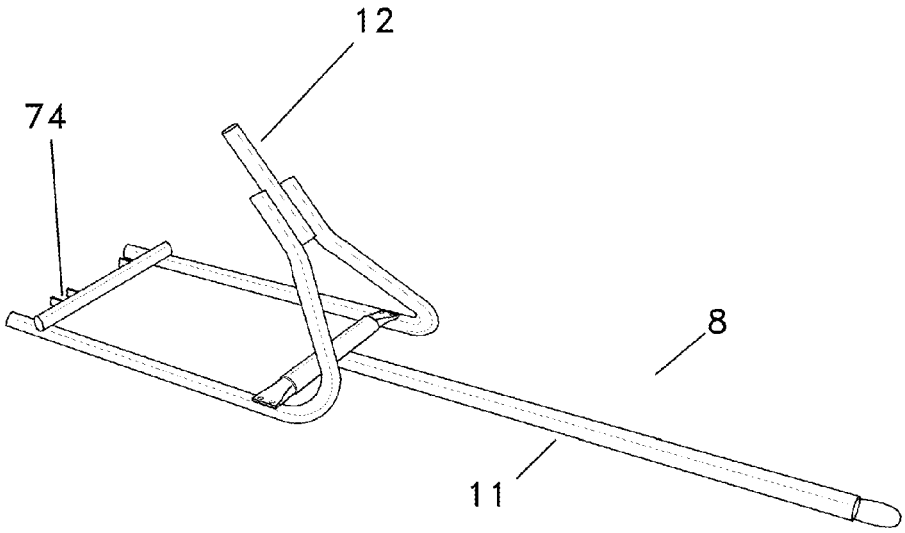
FIG. 16—is a perspective view of a support element in one embodiment.

As generally shown in FIG. 16, certain embodiments of such a support element (8) may include for example conveyable support element (10), such that said support element may couple to said animal form (2) and be conveyed as desired by an operator. As specifically shown, in FIG. 11, such an embodiment may include, for example, a conveyable sled (11). In a preferred embodiment, said support element (8) may be coupled (detachably or fixedly) to said animal form (2) through coupling with at least one integral aperture on said animal form (7). Such integral aperture may be an angled aperture that may further be reinforced with a metal or other reinforcing element. One such embodiment may include a hollow steel tube inserted and/or molded (and integral) to said animal form (2). Again referring to FIG. 11, in certain embodiments, such a support element (8) may include at least one angled release arm (12). Such an angled release arm may facilitate the desired detachment from such a support in response to the users roping action.

Figure 11:
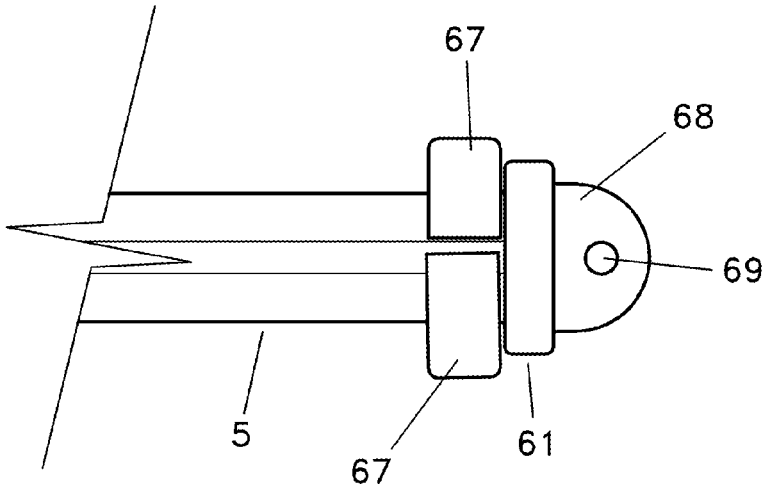
FIG. 11—is a top view of a resilient torsion control joint connection with a torsion control coupling distally coupled with a tension lock washer in one embodiment.

In one such embodiment, an animal form (2) may be coupled at a desired angle to a support element (8) through, for example a support attachment element (6) which, as shown in FIG. 11, be configured to be a conveyable sled (11), having at least one angled release arm (12) in a preferred embodiment being coupled to at least one integral aperture on said animal form (7) which may be a hollow steel tube positioned in the animal form's chest at an angle so as to detach from the sled for example when pulled on by an attached rope. In some embodiments the conveyable sled (11) may have a dual parallel bent hollow tube sliding base that provides stability as the animal form (2) is pulled across the ground. The sled may also have additional cross beams to secure the conveyable sled (11) into position. As shown in FIG. 11, the angled release arm (12) may be angled back so as to allow the animal form to slideably detach from, in this case a conveyable sled (11) (though such a slideably detachable feature may be general to all contemplated conveyable and stationary support elements generally) for example when pulled on by an attached rope. In certain embodiments, one of the cross beams may include a hind limb securement position (74) where the animal form's hind (rear) legs may be placed and secured within parallel brackets or other such appropriate securement device such that it does not lock the animal form into the conveyable sled (11) so as to allow the animal form's (2) hind legs to be detached with the form when pulled on by an attached rope. Additionally, a front cross beam may include an extended towing element. In one such embodiments, such an extended towing element may attach to a standard 2" towing ball or perhaps a rope and may facilitate the sled conveyance in a desired direction. In some embodiment this extended towing element may be a hollow 2" tube and may further be swivelable attached to a front cross-bar element allowing it to move up and down. In some embodiments it may also move laterally. Such a mounted animal form (2) may be conveyed by, for example a horse, hydraulic mechanism, ATV or other motorized vehicle. Further embodiments may contemplate, for example, a rail conveyable support element (13), where such rails may be fixed or adjustable. An additional rail brake may also be contemplated. Such rail mounted animal form (2) may be conveyed by, for example a horse, ATV or other motorized vehicle, or even by hand.

Additional embodiments, may include a motorized conveyable support element (15), Such an example would be a conveyable sled (11) and/or rail conveyable support element (13) controllably conveyed by a motorized device. Additional embodiments may contemplate a hydraulic conveyable support element (16), such that it is conveyed by a hydraulic device. Such an example would be a rail conveyable support element (13) controllably conveyed by a hydraulic device. Still, further embodiments may include a mounted animal form on a circularly conveyable support element (14). In such an embodiment, a mounted animal form (2) may be coupled to and conveyed by in a circular pattern by a centrally located motor, hydraulic or other appropriate device. Alternative embodiments may include, for example, a mounted animal form (2) tethered to a central rotation point and conveyed in a circular path by any of the aforementioned conveyance methods herein described.

Such embodiments may generally simulate a running animal, such as a calf running down the arena similar to rodeo type competition. This can allow training for both the roper and the roping horse. This may help train the calf horse to rate the calf, stop, take the hit, and work the rope. In one example a horse with a rider, comes out the roping box and chases the animal form (2) being conveyed, rates the calf, throws the loop, catches, the horse is then trained to stop immediately when, in this example the calf is lassoed so that the rope around the calf's neck stops the calf. The calf form in this example then slides off the conveyable sled (11) (similar action is also contemplated with in embodiments incorporating a support element (8) and/or stationary support element (9)) and is still attached to the rope. Then a rider can get off the horse, down the rope and flanks, gathers, and ties in this example the calf (though any animal form can be contemplated.) The weight of the animal form sliding or "popping off" the cart may give the horse the hit or jerk she may need to be reminded to keep the rope tight while rider is flanking and tying the animal form. In this way the current invention trains both the horse and roper. Generally, the support element (8) may hold the animal form (2) at the appropriate and desired angle to imitate a real running calf and provide an appropriate signal to the horse to keep the rope tight.

Additionally, the associated support element(s) (8) may be constructed from stainless steel which may or may not be anodized. Further, such a conveyable support element (10), such as a conveyable sled (11) may have removable wheels to allow it to be used on a variety of surfaces or said conveyable sled (11) may be adapted with rail slide attachments to ride along a rail that may be fixed and/or stationary perhaps pulled by a hydraulic, motorized and or automatic pulling or manual device.

Generally referring to FIGS. 2, 3, 12, 13-15 and 17, certain embodiments of the current inventive technology may include a tractable leg element having a knee joint (16). Such a knee joint may be a tractable knee joint, in that it may be moved in a plurality of directions similar to a real animal joint. Such a knee joint (16) may be beneficial as, for example, a front tractable leg element (3) at the knee has a joint that is tractable and falls back, or laterally flops like a real animal joint so the roper can hold it in the correct position when the left hand holds the front leg and gathers the rear back legs to tie. In some embodiments, for example a front tractable leg element (3) may laterally flop and/or bend voluntarily at the knee knuckle, which is beneficial when trying to properly hold and tie an animal such as a calf.

Again, generally referring to FIGS. 2, 3, 12, 13-15 and 17 in certain embodiments such a knee joint (16) may be a hinged knee joint (18). Such a hinged knee joint may be positioned to flexionally hinge similar to a live animal; however in certain embodiments such a hinge may still maintain a tractable character so as to allow slight lateral movement mimicking the knee joint of a real animal. Such a tractable hinged knee joint (21), as explained previously provides a simple and durable mechanical device that allows such lateral flop and/or bend (flexion) voluntarily at the knee knuckle, which is crucial to properly hold said leg when tying a calf. In addition, such a tractable hinged knee joint (21) may prevent undesired or excessive joint extension. Further embodiments may include for example a spring-loaded hinged knee joint (20), where such knee joint may be coupled with at least one spring, singly or in combination with a hinge joint apparatus, such that said spring may supply torsion resistance sufficient to provide resistance emulating a live animal. In addition, such spring-loaded hinged knee joint (20) may provide resistance and tension sufficient to cause the knee joint to be maintained at an approximately constant position, such a spring may further help a user to overcome the force of the spring-loaded joint to mimic the resistance exerted by a live animal. Such spring-loaded hinged knee joint (20) may also provide tension to form a return or default position, such as may be advantageous to reduce wear and tear as well as prevent degrading of the hinge joint and excessive flexion, extension or lateral flop.

Figure 12:
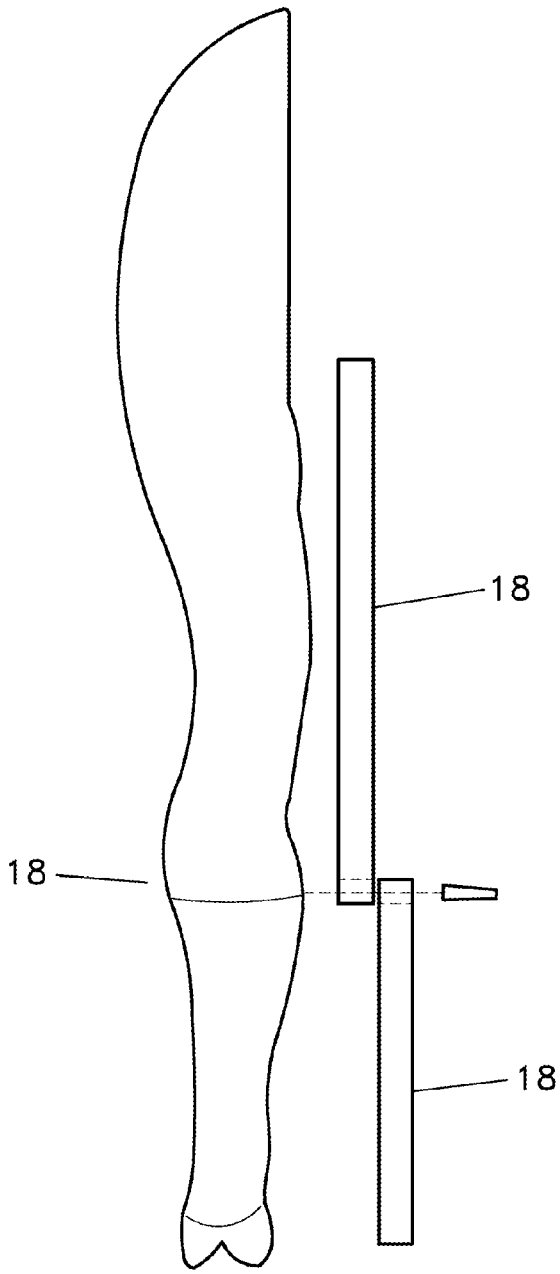
FIG. 12—is a front view of internal lateral support extension coupled to said hinged knee joint in one embodiment.
Figure 13:
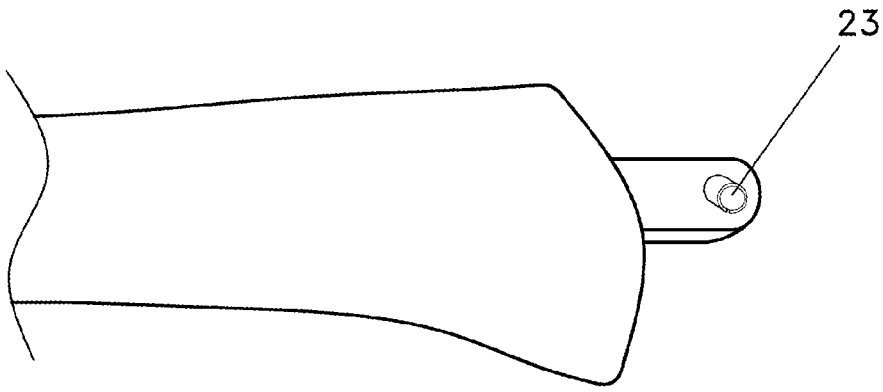
FIG. 13—is a top view of a disarticulated knee joint in one embodiment.
Figure 14:
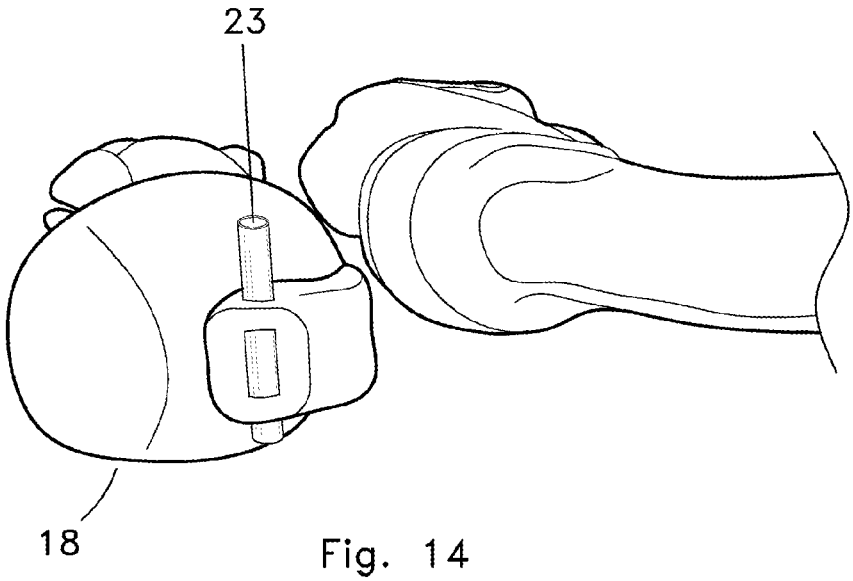
FIG. 14—is a front view of a disarticulated knee joint in one embodiment.

As generally shown in FIG. 12-14, certain embodiments may include a slotted pin coupling (or coupler) (22) such that, for example an internal lateral support extension coupled to said hinged knee joint (19), such that a metal bar is extended through one or more disarticulated tractable leg element(s) (3). In one embodiment, such an internal lateral support extension coupled to said hinged knee joint (19) are slotted into one another forming a hinge joint and secured with a pin. Such a configuration provides a durable and simple hinge joint that can be quickly dissembled and re-assembled and or replaced. The configuration and tensions between the elements may allow such a joint to be tractable allowing for such desired extension, lateral flop while still preventing excessive flexion and extension. As such, embodiments of the current inventive technology may contemplate a detachable hinged knee joint (24). Such detachment may be manual or automatic upon crossing a pre-determined threshold force.

Figure 15:
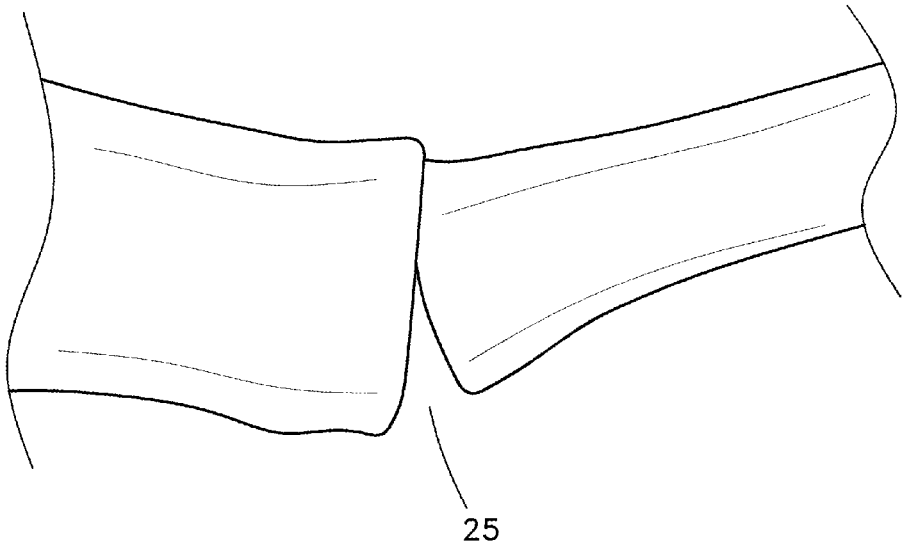
FIG. 15—is a top view of an articulated knee joint bent at an angle in one embodiment.
Figure 17:
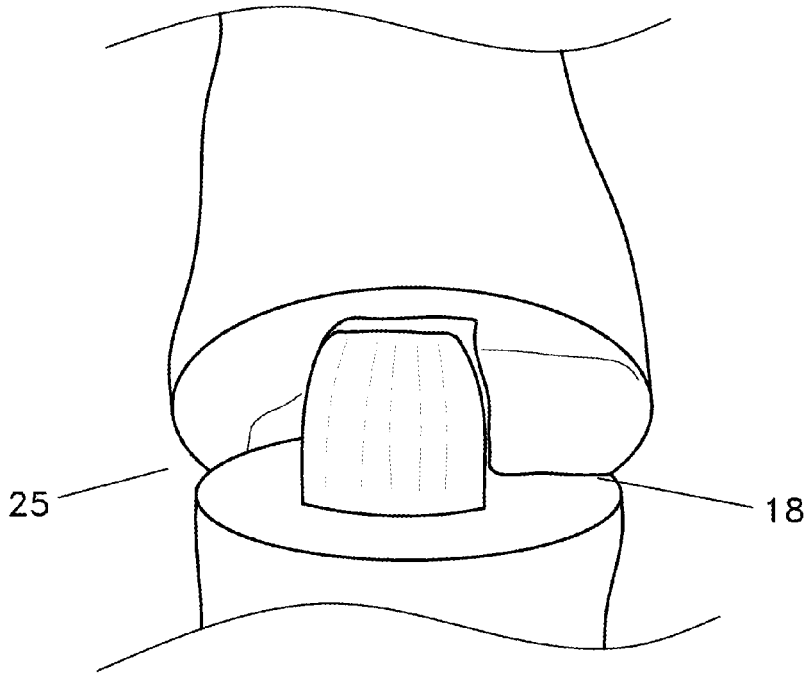
FIG. 17—is a front view of an articulated knee joint in one embodiment.

Also as shown in FIGS. 15 and 17, certain embodiments of the current inventive technology may include slotted hinged knee joint configured to slideably traverse past a longitudinal hinge axis (25). Such slotted arrangement may be integral to the tractable leg elements (3) and may be created during the molding and casting process or may be shaped later according to a user's desire or specific animal form replicated. As such, the inventive technology allows for the knee joint to extend in slotted arrangement so as to provide additional durability to the extent that such a knee joint may be inappropriately or excessively extended or laterally traversed. Further embodiments may also contemplate a hinge lock (29) (not shown) so as to fix said knee joint (16) in a specific position. Such a position being either extended, and or flexed.

As will be discussed in more detail below, certain embodiments of the invention may include a knee joint (16) tension coupled to one another perhaps through resilient torsion control joint connection wherein the proximal and distal portions of disparate leg elements are tension coupled by operation of a resilient torsion control joint connection (23). Such a configuration would, similar to the below describe tractable leg tension coupling, provide a durable tractable leg joint, that may detach in response to excessive force and be easily reattached for continued use. Such a configuration could be coupled with for example a hinged knee joint (18) or slotted pin coupling (22) for additional flex/extension as well as lateral flop control.

Certain other embodiments contemplated may include an array of a customized configuration(s) of a plurality of hinged and/or fixed tractable leg elements (26) such that embodiments may include a configuration wherein said front leg elements are hinged and said rear leg elements are fixed (27) whereas other configurations may include a configuration where a single front leg is hinged while the remaining leg elements are fixed (28). Further embodiments may include no hinged tractable leg elements and/or all hinged tractable leg elements, or any combination therein as dictated by a user's desire or animal being represented.

Figure 2:
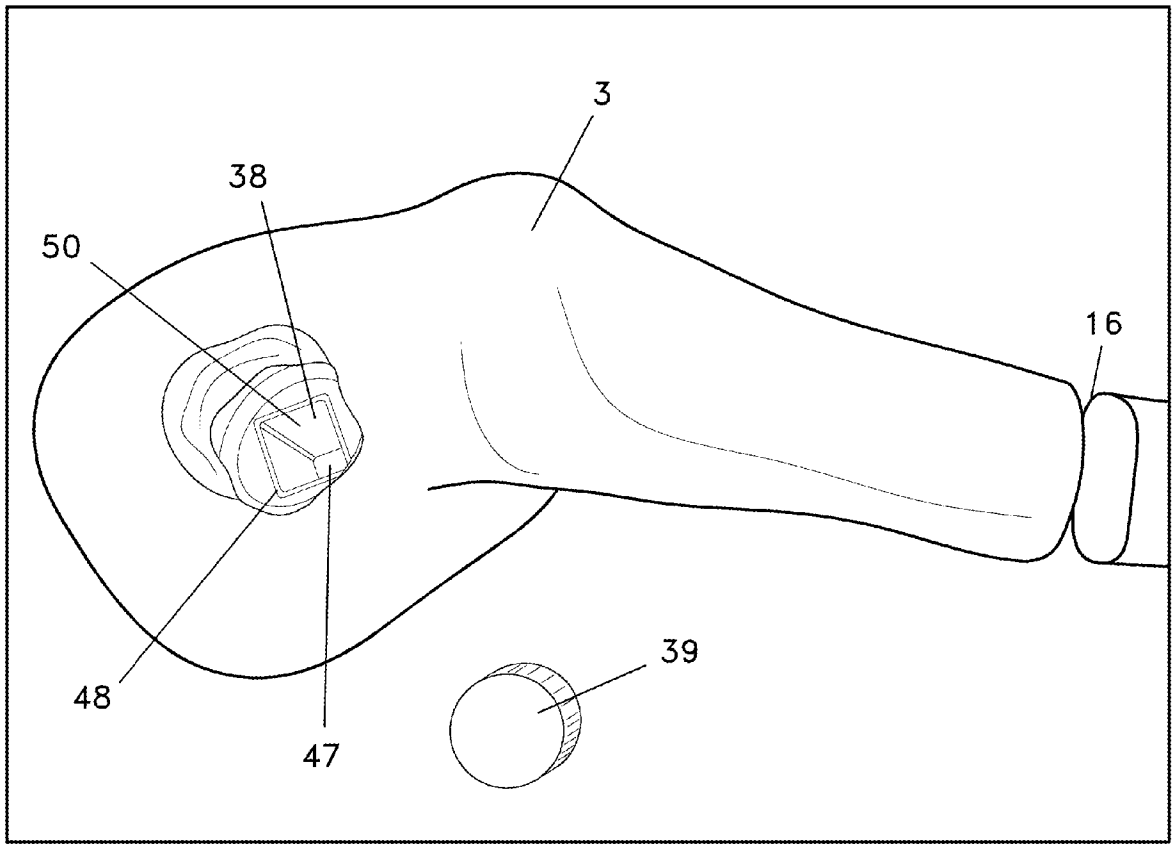
FIG. 2—is a top view of a disarticulated tractable leg element with a external joint access slot in one embodiment.
Figure 3:
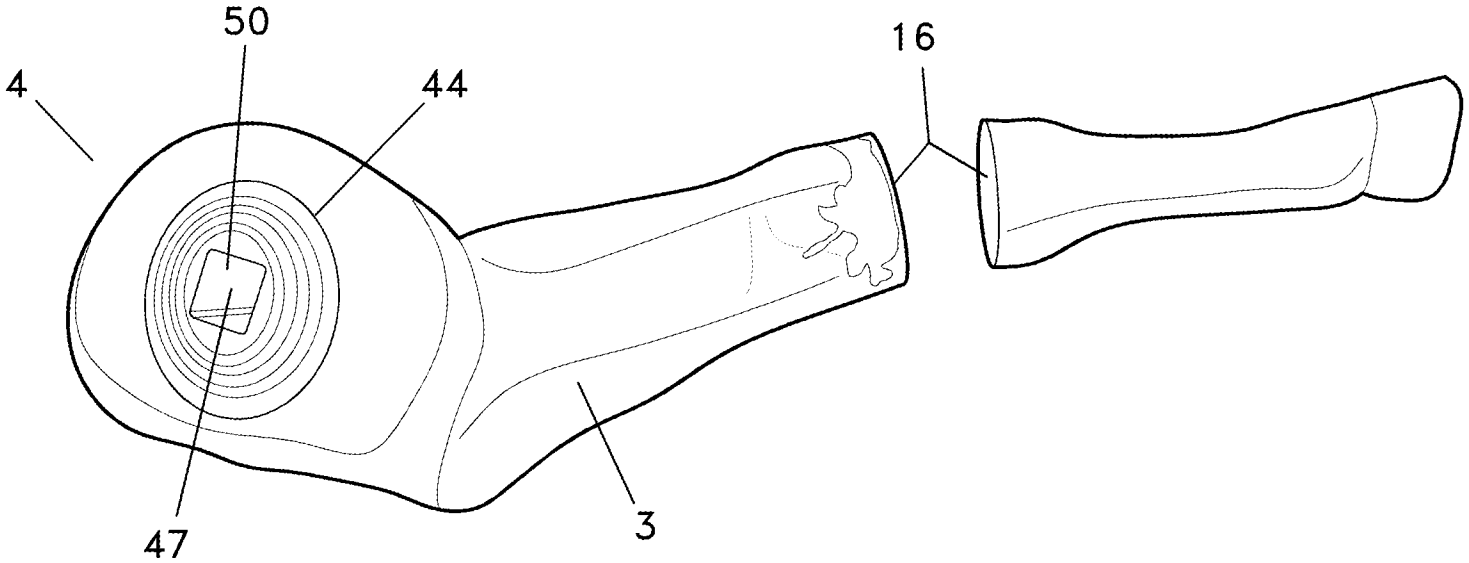
FIG. 3—is a bottom view of a disarticulated tractable leg element.

Generally referring to FIGS. 2 and 3, some embodiments of the current invention include at least one tractable leg element (3). As herein described, and as can be seen from the figures, through operation of said resilient torsion control joint connection (5) and said joint element (4) (independently or working in conjunction) said leg element is tractable such that it may traverse in-line along the length of the animal form, as well as traverse in a plurality of directions. Such tractability mimics the lateral, angled and in-line movement of the ligament secured shoulder and hip joints of real animal and thus renders the current inventive technology an improved emulation of such real and tractable joints.

Again generally referring to FIGS. 1-5, in a preferred embodiment such a joint element (4) may be ball and socket joint (43). Further, and again referring to FIGS. 1-5, such a ball and socket joint (4) may be configured with disparate corresponding ball and socket joint elements wherein said ball joint element is coupled with said tractable leg element and said socket joint element is coupled with said animal form (44). Further embodiments may include as well as at least one disparate corresponding ball and socket joint element wherein said ball joint element is integral to said tractable leg element and said socket joint element is integral to said animal form (45). In such an embodiment, such ball and socket joint elements may be integral to said animal form (2) and tractable leg elements (3). Such integration may be achieved through molding and casting steps where said elements are cast into the animal form and leg elements or in alternative embodiments, such joint element(s) (4) may be separately inserted and/or secured. As such, these joint element(s) (4) may be additionally supported by the natural operation of being internally positioned and may have protrusion, lips catches or edges or other elements to secure them within the cast material.

Figure 5:
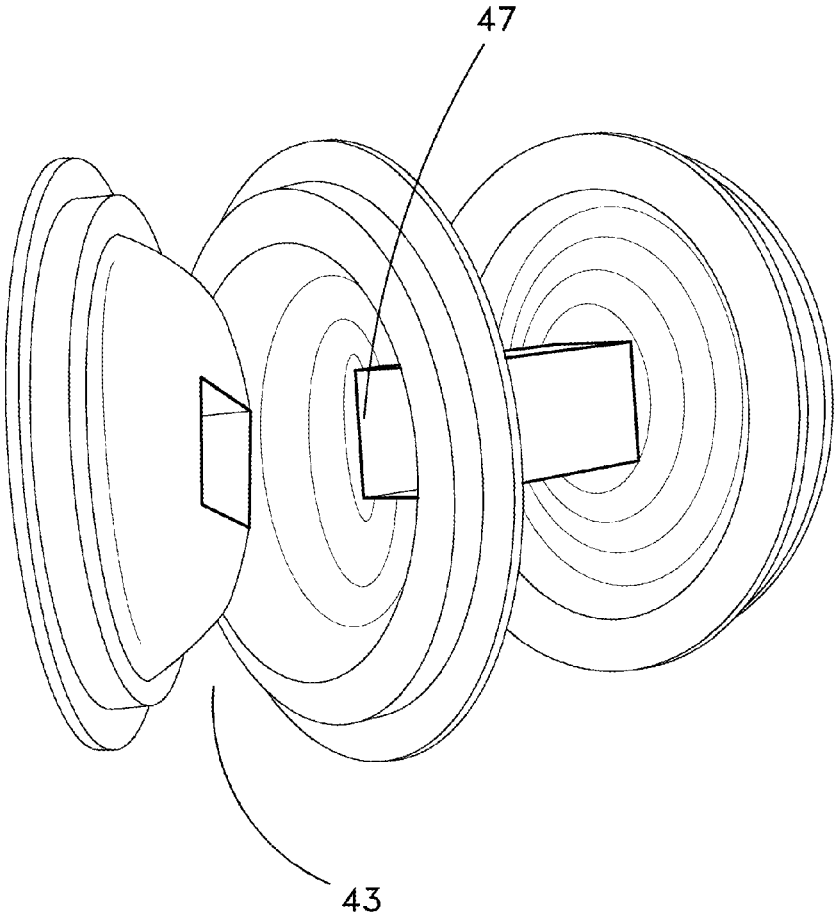
FIG. 5—is a perspective view of a joint element in one embodiment.
Figure 6:
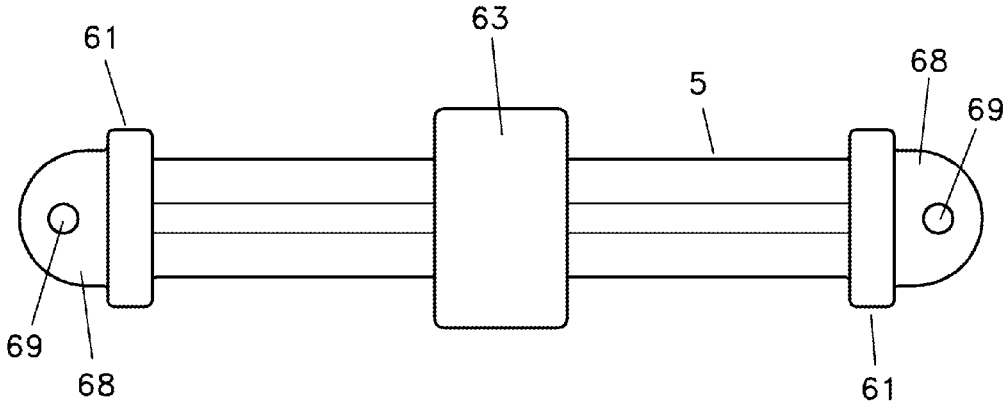
FIG. 6—is a top view of a resilient torsion control joint connection with a torsion control coupling in one embodiment.

Referring to FIGS. 1 and 5, it can be seen that such a socket joint element coupled with said animal form (44) may, in fact, be a continuous single joint element penetrating said animal form (46). (Non-continuous configuration are additionally contemplated.) Such a continuous single joint element penetrating said animal form (46) may form a joint aperture (47) that internally spans the animal form (2). In the current embodiment, such joint aperture (47) is square. As will be discussed in further detail below, such joint aperture (47) may form a channel for insertion and securement of a resilient torsion control joint connection (5) to facilitate the tension coupling of said tractable leg elements (2) to said animal form (2).

Now, referring to FIGS. 2 and 3, as discussed, in a certain embodiment where said ball joint element is coupled with said tractable leg, (also having a corresponding joint aperture (47)), such joint element may contain an inverted extension barrier (48). Such an inverted barrier may be situated inside and directed inward toward the center of the shoulder and/or hip joint. As previously discussed, such joint aperture (47) may be utilized by extending the distal ends of said resilient torsion control joint connection (5) through the internal joint aperture (47) on, for example, said joint element of said tractable leg elements (44) approximately beyond at least one inverted extension barrier (48). Additional steps may include, as referenced in FIG. 11, for example, securing at least one tension lock washer (66), which in one embodiment may include a plurality of shaped split washers (67), around said resilient torsion control joint connection (5), followed by the step of releasing said extended resilient torsion control joint connection (5) such that said tension lock washer (66) is fitted in at least one resilient torsion control joint connection tension coupling slot (50). Such lock washer (66) may be fitted to a distal resilient torsion control joint projection (61), perhaps proximally. Such lock washer (66) may provide a durable surface so as to aid in the tension securing of the aforementioned elements through operation of the resilient torsion control joint connection (5). In addition, such lock washer (66) may prevent tearing, or cutting forces as well as wear and tear by acting as a physical buffer and/or barrier between said resilient torsion control joint connection(s) (5) and said joint elements (4), inverted extension barrier (48) and/or tension coupling slot (50). As such it may be desired that such lock washer (66) may be fabricated of a harder material that said resilient torsion control joint connection (5). In a preferred embodiment, such material may have a higher resistance to torsion forces.

Additional embodiments may include a non-continuous inverted extension barrier (49), such that the extended walls of the inverted extension barrier may be removed or slotted on at least one side, or in a preferred embodiment opposing sides so as to allow access to insert lock washers (66) when extending the distal ends of said resilient torsion control joint connection (5) through an internal joint aperture (47).

Additional embodiments of said joint element (4) contemplate a variety of different joint configurations. In particular, said ball and socket joint (43) may have a variety of embodiments which may include, for example, a shallow non-load carrying ball and socket joint (51) and/or a shallow low-load carrying friction ball and socket joint (52). Such term generally describing a ball and socket that may float and/or not be secured through their natural operation such that the individual joints do not possess sufficient friction and/or securement to carry any/or the full weight load of said animal form with such further connection as herein described. One advantage of such a no and/or low load configuration is that it simplified the mechanical joint coupling such that excessive or angled force on the joint may not break the ball secured within the socket resulting in fewer opportunities for breakage due to excessive force application. Further embodiments may include a deep load carrying fitted ball and socket joint (53) such that said ball is more deeply and/or securely placed within said corresponding socket so as to allow for load bearing sufficient for said animal form (2) to stand and be utilized for example without the aid of a support element (8) or other support.

Additional embodiments of the following inventive technology may include, for example, a mechanical coupling (54) where, for example, said joint element (4) may mechanically couple and/or lock to the animal form (2) forming a physical non-resilient coupling with the animal form. In such an embodiment the mechanical coupler may include a corresponding joint element on and/or integrated in said animal form (2) and said tractable leg element(s) (3) such that they may be mechanically coupled. Such mechanical coupling may occur through, for example, a slot, slide and clamp and or quick release type coupling. Further embodiments may include an integral coupling (55), such that said coupling is integral to the animal form and leg elements, perhaps though a single monolithic cast. Further, as can be appreciated, each of the joint elements (4) may be constructed from a variety of materials such as aluminum, steel, graphite composite, composite material, plastic, flexible PVC, hard plastic and the like to provide better durability and strength.

Generally referring to FIG. 2, embodiments of the current inventive technology may include an external joint access slot (38). Such a slot may provide access to said internal aspect of a joint element (4), and at least one particular inverted extension barrier (48) and/or a joint aperture (47). As detailed above, such a joint element (4), in this embodiment may be a ball and socket joint (43) or more specifically a disparate corresponding ball and socket joint elements wherein said ball joint element is coupled with said tractable leg element and said socket joint element is coupled with said animal form (44). Access to such internal aspect may be beneficial so as to facilitate tension coupling of said tractable leg elements (3) to said animal form (5) though operation of said resilient torsion control joint connection (5).

In some embodiments, as can be appreciated, such an element encompass a removable external joint access slot cap (39) to cover and protect such internal aspect and to prevent dirt and or exposure of such internal aspect or tension coupling. As can readily be appreciated, such removable external joint access slot cap (39) may be beneficial for access to adjust, and/or replace such elements as necessary as well as to ease initial manufacture. In some embodiments, such a cap may be a fitted removable external joint access slot cap (40). Such a fitted cap may have the additional benefit of being substantially hidden and leave for example the joint caps substantially planar with the outer surface of the animal form (2) so as to not interfere with said apparatus or its use. In addition, such a fitted removable external joint access slot cap (40) provides a simple device that may further act as an effective barrier to dirt and exposure to elements, while allowing access to the internal aspect of a tractable leg element (3) facilitating tension or other types of coupling, replacement, manufacture and/or adjustment.

Figure 18:
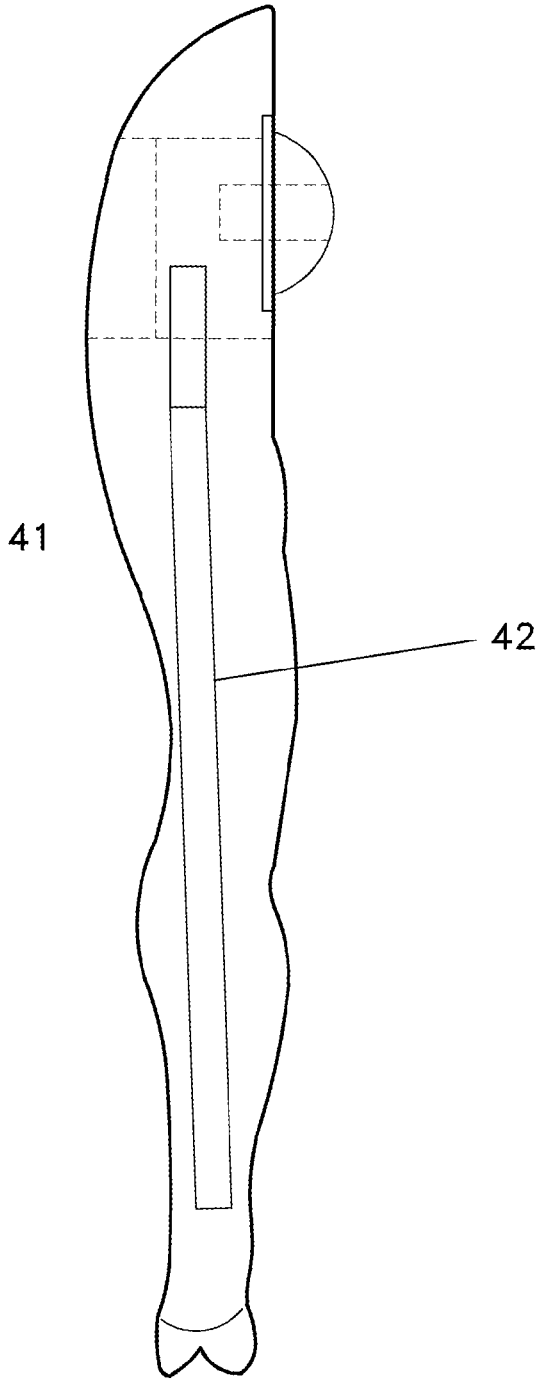
FIG. 18—is a front view of an internal support in one embodiment.

Generally referring to FIG. 18, in some embodiments it may be desired to provide a reinforcing aspect to said tractable leg element(s) (3). As such, the invention may include an internal support (41), such that said tractable leg element(s) (3) are reinforced and more resistant to lateral or other directional torsion forces. This is especially important giving the substantial multi-directional forces placed on the leg elements. In addition, such an internal configuration allows such internal support(s) (41) to be molded directly into said animal form (2) increasing their strength and torsion resistance, as well as simplifying the apparatus generally as well as preventing any support elements from breaking off or being bent. Such an internal configuration further maintains the desired emulation of an actual animal form (2) that is important to the training aspect of the current invention. Additional embodiments may include internal lengthwise support bar (42). While not shown, external supports may also be contemplated within the scope of the current invention to achieve the desired reinforcement.

Figure 7:
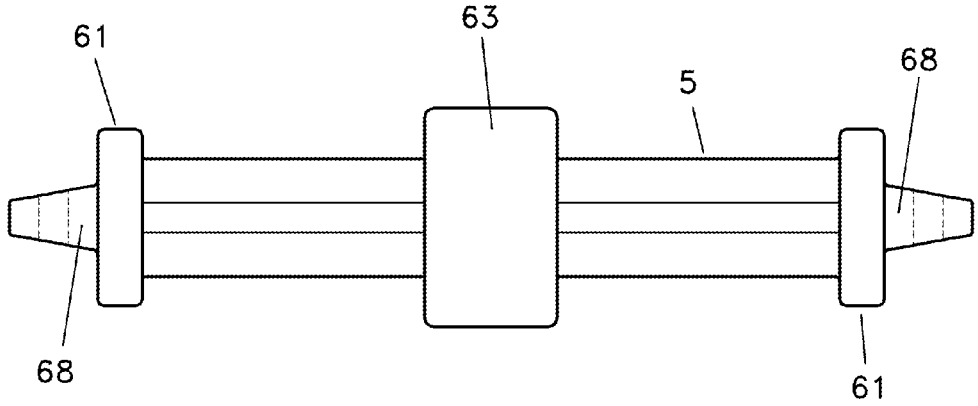
FIG. 7—is a side view of a resilient torsion control joint connection with a torsion control coupling in one embodiment.

As generally described in FIGS. 6-9, the current inventive technology may include at least one resilient torsion control joint connection (5). As previously described, in certain embodiments, one or more tractable leg elements (3) may be tension couple to said animal form (2). In one embodiment two tractable leg elements (3) are tension coupled together securing by tension an animal form (2) in-between. In some embodiments such coupling is through a joint element (4) such as corresponding ball and socket joints (43). Such tension coupling may occur as the distal ends of said resilient torsion control joint connection (5) are extended through the internal joint aperture (47) on, for example, said joint element of said tractable leg elements (44). In one such embodiment as shown in FIG. 7, such a resilient torsion control joint connection (5) may be an extended tension spring such that it is resilient in that it may resist torsional force and return to an original position. Further such connection may control torsion being designed to allow, for example, tension coupled tractable leg elements to traverse in an in-line manner, resulting in a torsional twist on the connection. The strength, design and material used can determine the amount of torsional resistance the connection may allow. In addition, the design, and material used, may allow in some embodiments an elastic characteristic. As such, in some embodiments tension coupled tractable leg elements may pull longitudinally and or upward, for example, and said connection may elastically stretch. Such force is also resisted and may return to a default position.

As such it can be appreciated that such a novel connection is advantageous for the current application. Utilizing such a resilient torsion control joint connection (5) may allow, for example, the tractability of said leg elements in that they may not only be moved in an in-line direction when gathered for example when gathered, but can be multi-directionally moved without breaking, such as laterally. In addition such torsion is resisted, and the elastic and torsion control aspect may more easily return the legs to a default position, such as when a user releases a gather. (It should be noted that the term torsion in this context may mean any force exerted in any direction including but not limited to compression, extension rotation, torque and or force applied movement in any direction.) Such a resilient torsion control joint connection (5) may be made of any elastic and or torsional resistant materials. In some embodiments such material may include for example ethel vinyl acetal or other composite materials.

Figure 19:
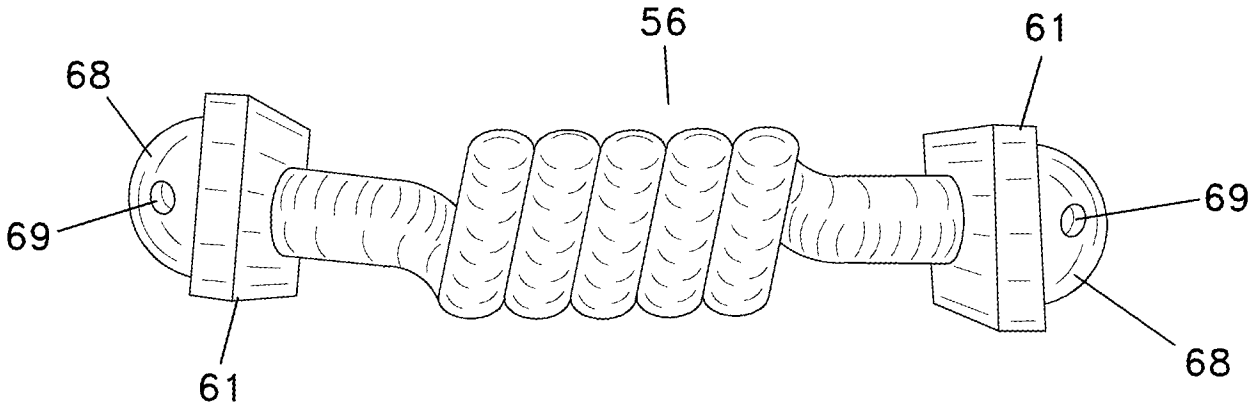
FIG. 19—is a front view of a resilient torsion control spring joint connection in one embodiment.
Figure 20:
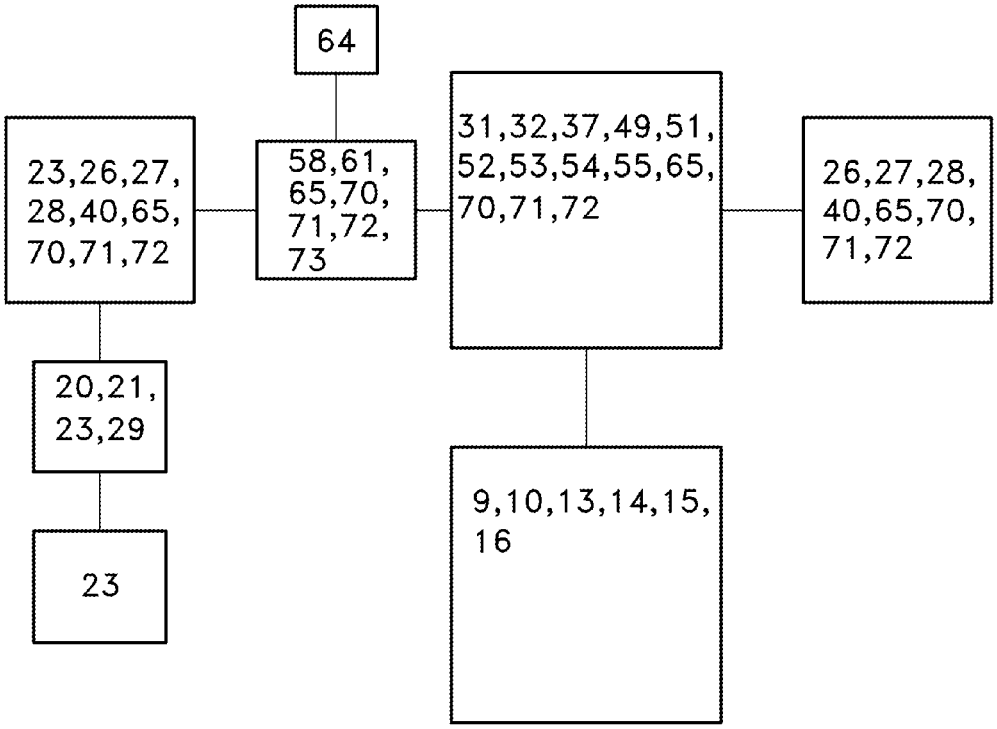
FIG. 20—is a conceptual diagram view of an improved animal form.

As shown in FIG. 19, such central connection may in fact in some embodiments be a resilient torsion control spring joint connection (56). Such spring configuration may provide additional resilient and torsion control attributes as previously described. Further, various embodiments may include at least one polyurethane resilient torsion control spring joint connection; and at least one ethel vinyl acetal resilient torsion control spring joint connection; at least one plastic resilient torsion control spring joint connection; at least one flexible PVC resilient torsion control spring joint connection; and at least one composite resilient torsion control spring joint connection. Still further embodiments may include a metal resilient torsion control spring joint connection (60).

In addition, certain embodiments may include a variable torque resilient torsion control spring joint connection (61). Such variable torque maybe achieved in a variety of ways including, but not limited to, resilient torsion control joint connections having least one resilient torsion control spring joint connection selected from the group consisting of: at least one variable coil strength resilient torsion control spring joint connection; at least one variable coil size resilient torsion control spring joint connection; at least one variable coil length resilient torsion control spring joint connection; at least one variable coil pitch resilient torsion control spring joint connection; at least one variable coil diameter resilient torsion control spring joint connection; at least one variable active coil resilient torsion control spring joint connection; at least one variable spring constant resilient torsion control spring joint connection; and at least one variable coil number resilient torsion control spring joint connection. Additional embodiments may also have resilient torsion control joint connections having variable elasticity based on design and/or material used as described above as can be appreciate by one skilled in the art.

Figure 8:
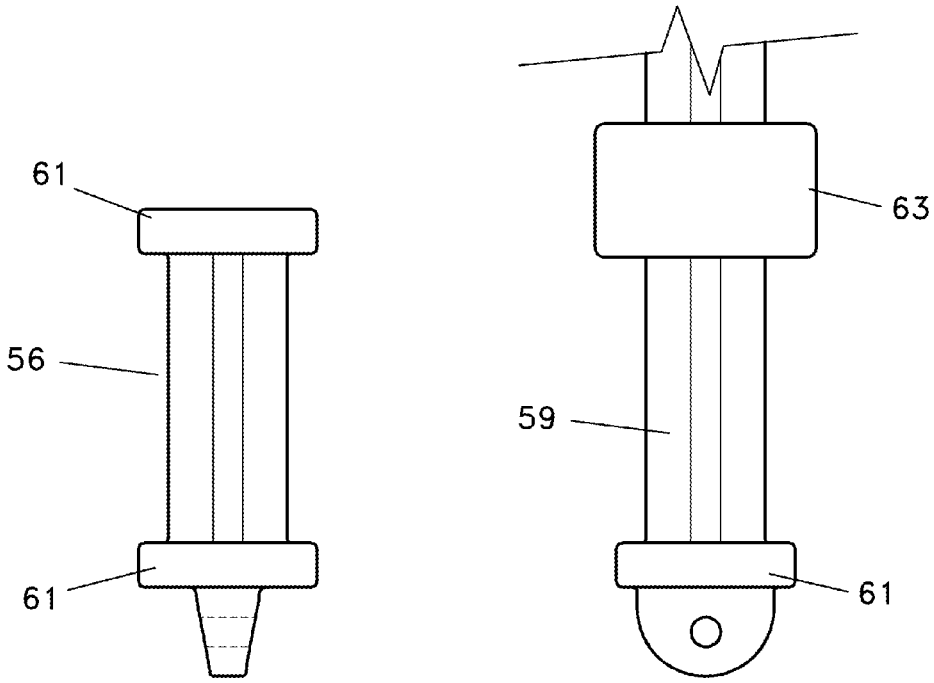
FIG. 8—is a top view of a resilient torsion control joint connection with a torsion control coupling in one embodiment and non-spanning resilient torsion control joint connection in one embodiment.
Figure 9:
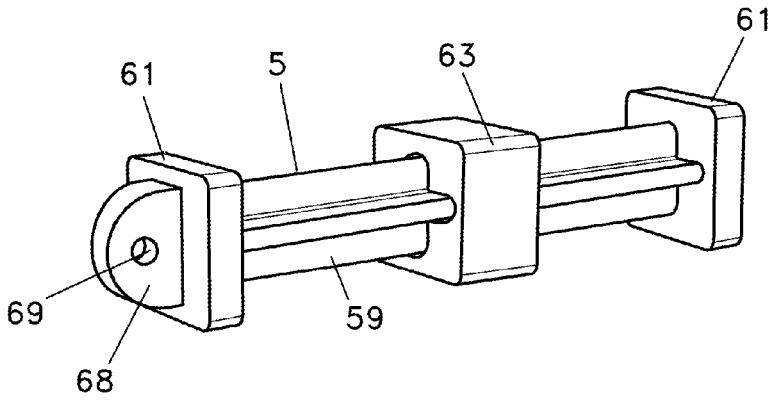
FIG. 9—is a perspective view of a resilient torsion control joint connection with a torsion control coupling in one embodiment.
Figure 10:
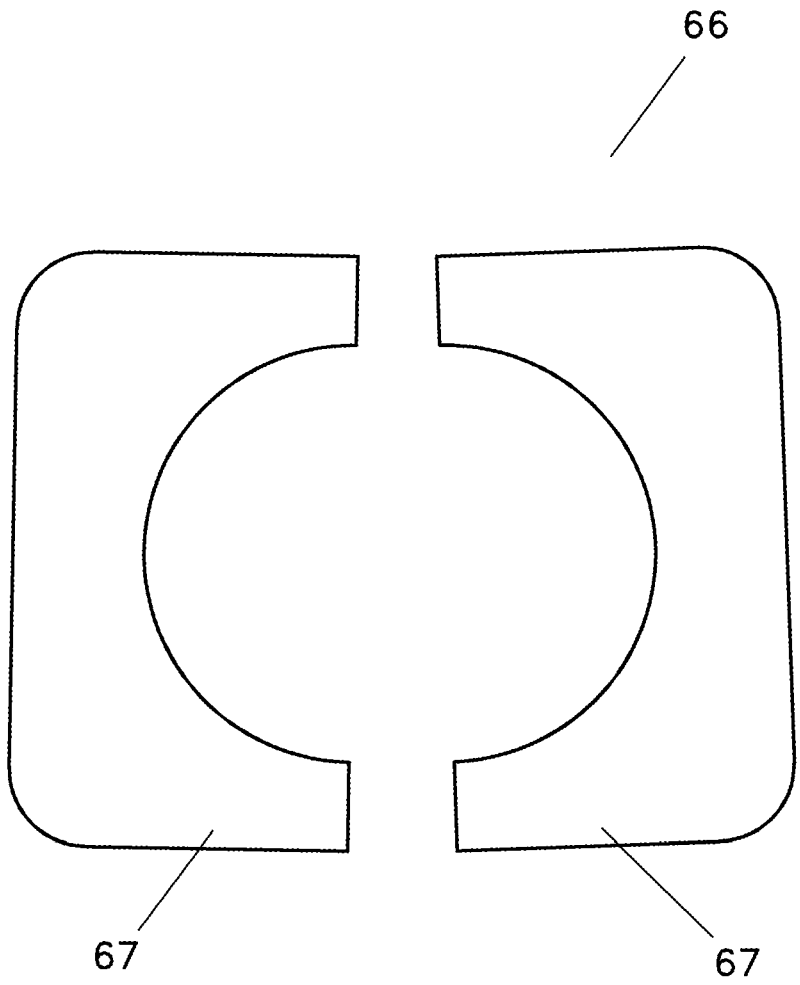
FIG. 10—is a top view of a tension lock washer in one embodiment.

Referring to FIG. 8 certain embodiments may include at least one non-spanning resilient torsion control spring joint connection (58). In this embodiments, similar to the resilient torsion control joint connection (5), such non-spanning configuration does not internally penetrate said animal form (2) though a joint aperture (47). Instead the proximal base is secured to said animal form (2) perhaps through a joint element (4). Then distal end of said non-spanning resilient torsion control spring joint connection (58) is extended through the internal joint aperture on, for example, said joint element of said tractable leg elements (44) and secured in a manner as previously described. In this manner, a single tractable leg element (3) may be tension coupled to an animal form (2), where perhaps the other legs are integral to, and/or integrally and/or mechanically coupled to said animal form (2).

As generally referenced in FIG. 6-9, certain embodiments may include, for example, a resilient torsion control shaped extension joint connection (59). In such an embodiments, the central portion of such a connection is shaped such that it may have a variable torsional control or resistance as well as elasticity. In certain embodiments, such shaped extensions may include length-wise protrusions providing additional torsion control and elastic characteristics as desired. Such shaped elements may be, for example, integral or later added. Further such shaped forms may be extruded and may be in a variety of configurations, and may in fact twist around the axis of the central portion of the connector as desired. (It should also be noted that the term spring may include non-coiled springs and shaped extensions.)

As previously described, in some embodiments such tension coupling a plurality of leg elements with said animal form by extending the distal ends of said resilient torsion control joint connection (5) through the internal joint aperture (47) on, for example, said joint element of said tractable leg elements (44) approximately beyond at least one inverted extension barrier (48). Additional steps may include, as referenced in FIG. 11, for example, securing at least one tension lock washer (66) (which may be in a staggered configuration to accommodate a variety of shaped connection configurations), which in one embodiment may include a plurality of shaped split washers (67), around said resilient torsion control joint connection (5), followed by the step of releasing said extended resilient torsion control joint connection (5) such that said tension lock washer (66) is fitted in at least one resilient torsion control joint connection tension coupling slot (50). Such lock washer (66) may be fitted to said distal resilient torsion control joint projection (61), perhaps proximally. In some embodiments such extension and tension coupling may be facilitated thorough at least one distal installation pull element (68) having perhaps a pull aperture (69). In such an embodiment, such element may provide a "grip" to help overcome the resilient nature of such a connection when extending it for such tension coupling. Further, a simple hook or other penetrating device may catch such pull aperture (69) to aid in such extension action.

Now, referring to FIGS. 6-9, some embodiments of the current inventive technology may include for torsion control coupling (63), which may include a centrally positioned torsion control coupling (64). Such torsion control coupling (63) may act to keep the torsion exerted on one end of the connection independent from the other end allowing for independent torsion control of individual tractable leg elements (s). Such torsion control coupling (63) may be combined from multiple elements secured to the central extension of a resilient torsion control joint connection (5). Such torsion control coupling centrally positioned to equally divide such torsional separation and control. Further embodiments may include, for example, a slotted torsion control coupling fitted within a socket joint element integral to said animal form formed by a continuous single joint element penetrating said animal form having at least two opposing socket elements connected by a joint aperture such that it may accommodate at least one resilient torsion control joint connection (65).

As can be appreciated from the forgoing, it may be advantageous to pre-load at least one tractable leg element (3) coupled to an animal form (2) by at least one joint element (4). In certain embodiments such pre-loading may include providing an initial torsional force on at least one resilient torsion control joint connection (5) wherein said tractable leg element (3) may naturally desire a return to an equilibrium or default state. In such an embodiment, this pre-loaded torsion force may cause the natural operation of, for example, the rear tractable leg elements (3) to traverse outward by default. While in another example such pre-loaded torsion force may cause the natural operation of, for example, the front tractable leg elements (3) to traverse outward by default. As a result of such a pre-loading, tension coupling may encompass a pre-loaded resilient torsion control joint connection (70) that may establish at least one pre-set return default position for at least one of said tractable leg element (72). Such pre-loading may be achieved in some embodiments though insertion of a "tractable leg element (3) at an angle in relation to the animal form (2). In still further embodiments such pre-loading may be achieved by forming, inserting or twisting a joint element (4) and/or resilient torsion control joint connection (5) in a tension induced state and/or forming, for example, at least one angled resilient torsion control joint connection configuration (71).

Additional embodiments of the current inventive technology may include, for example, internal springs from the hip to the tractable leg elements (3), such that that a user may need to push forward with his right leg to keep the leg element in proper position for gathering and to prevent the leg from resisting and "kicking" back.

Additional embodiments of the current inventive technology may include improved animal roping system kit (73). Such an embodiment may include, for example, pre-fabricating and packaging all of said parts and components into a self contained kit for sale to potential consumers. Such kits may be customized according to type, size as well as other attributes of the animal form (2) as well as customized tractable leg element(s) (3) as well as customized configurations as herein discussed.

Specifically contemplated in various embodiments of the current inventive technology is at least one mechanical joint connection (73), such that a tractable leg element (3) is mechanically coupled to an animal form (2) through a mechanical joint connection (73). Such a mechanical connection contemplates physical coupling apart from tension coupling wherein the aforementioned elements are physically attached while retaining their described tractable features. Additional embodiments may include an integral coupling such that a tractable leg element (3) is mechanically coupled to an animal form (2) through an integral joint connection (not shown). In some embodiments such an integral joint connection may be a single mold integrally incorporating said leg element (3) that is mechanically coupled to an animal form (2) in a non-tractable fashion. In some embodiments, such as a goat animal form, such an integral joint connection may be contemplated with, for example, a knee joint (16) and/or hinged knee joint (18) on one or more leg elements. Such an embodiment may be appropriate for small children and may be able to, for example, balance on the ground without the need for a support element (8). Other such embodiments may include a single tractable leg element (3), a non-spanning resilient torsion control joint connection (57) a joint element (4), while the other three legs are coupled to the animal form (2) which, for example, are integral joint connections.

In some embodiments an animal form (2) form may be molded to replicate a 150-175 pound cross bred calf, typical of a real roping calf. Additional embodiments may include the use of perhaps a bungee cord or other elastic or pressure element to secure the leg elements to the animal form. In some embodiments the rear legs may have torsion spring coordinated with their hips connected to a rod running throughout the length of both legs; mimicking the kicking of the calf when gathering legs. It teaches the roper to squeeze with his/her legs when gathering the legs to avoid a kick loose from the calf roping knot. In some embodiments the animal form may include a stationary position, for example, a knee hinge lock or other stand alone embodiment that may allow it to be used to simulate tying off the chute without being, for example, on a horse. In such an embodiment a user could tie the calf to the chute, run down the rope, flank and tie to practice without having to be on a horse. Also a motion generating device may be mechanically coordinated to the animal form's legs to simulate motion as a user is attempting to tie the legs. Additional embodiments may include a variety of colors such as pink for girl and blue for boys and the like, as well as personalized marks such as a personal brand, or company logo in the mold.

Naturally, all examples discussed herein are merely illustrative and should not be construed to limit the scope of the inventive technology consistent with the broader inventive principles disclosed. While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the statements of invention.

As can be easily understood from the foregoing, the basic concepts of the present invention may be embodied in a variety of ways. It involves both methods of utilizing and manufacturing such an animal roping system as well as devices to accomplish the appropriate animal roping system. In this application, the animal roping techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting any claims. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "resilient torsion joint connection" should be understood to encompass disclosure of the act of "resilient torsion joint connecting"—whether explicitly discussed or not—and, conversely, were there effectively disclosure of the act of "resilient torsion joint connecting", such a disclosure should be understood to encompass disclosure of a "resilient torsion joint connection device" and even a "means for resilient torsion joint connecting." Such changes and alternative terms are to be understood to be explicitly included in the description.

Any patents, publications, or other references mentioned in this application for patent are hereby incorporated herein by reference in their entirety. Any priority case(s) claimed by this application is hereby appended and hereby incorporated herein by reference in their entirety. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated herein by reference in their entirety. Finally, all references listed in the list of References To Be Incorporated By Reference In Accordance With The Patent Application or other information statement filed with the application are hereby appended and hereby incorporated herein by reference in their entirety, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the improved animal roping system(s) as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group*, PLC, 479 F.3d 1313 (Fed. Cir 2007), or the like are expressly not intended in this or any subsequent related matter.

In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 715 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. An improved animal roping system comprising:

at least one animal form;

at least one tractable leg element coupled to said animal form by at least one joint element; and at least one resilient torsion control joint connection wherein said tractable leg element is tension coupled to said animal form by operation of said resilient torsion control joint connection.

2. An improved animal roping system as described in claim 1 wherein said animal form comprises an animal form selected from the group consisting of: a calf form; a goat form; a steer form; a lamb form; and a sheep form.

3. An improved animal roping system as described in claim 1 wherein said animal form comprises at least one animal form selected from the group consisting of: a urethane expanding flexible foam animal form, a plastic animal form, a composite material animal form, a foam animal form; a poly-urethane animal form; a flexi-foam rubber animal form; a rubber animal form; and injection molded animal form.

4. An improved animal roping system as described in claim 1 wherein said animal form comprises at least one support attachment element.

5. An improved animal roping system as described in claim 1 and further comprising at least one support element capable of coupling to said animal form.

6. An improved animal roping system as described in claim 1 wherein said tractable leg element comprises at least one tractable leg element with at least one knee joint.

7. An improved animal roping system as described in claim 6 wherein said tractable leg element with at least one knee joint comprises at least one tractable leg element with at least one hinged knee joint.

8. An improved animal roping system as described in claim 1 wherein said animal form comprises at least one flank handle.

9. An improved animal roping system as described in claim 1 wherein said joint element comprises at least one ball and socket joint.

10. An improved animal roping system as described in claim 9 wherein said ball and socket joint comprises disparate corresponding ball and socket joint elements wherein said ball joint element is coupled with said tractable leg element and said socket joint element is coupled with said animal form.

11. An improved animal roping system as described in claim 10 wherein said ball joint element coupled with said tractable leg element comprises at least one joint aperture such that it may accommodate at least one resilient torsion control joint connection.

12. An improved animal roping system as described in claim 11 wherein said joint aperture of said ball joint element coupled with said tractable leg element comprises at least one inverted extension barrier.

13. An improved animal roping system as described in claim 12 wherein said inverted extension barrier comprises at least one resilient torsion control joint connection coupling slot.

14. An improved animal roping system as described in claim 1 wherein said resilient torsion control joint connection comprises at least one resilient torsion control spring joint connection.

15. An improved animal roping system as described in claim 14 wherein said resilient torsion control spring joint connection comprises a resilient torsion control spring joint connection selected from the group consisting of: at least one polyurethane resilient torsion control spring joint connection; and at least one ethel vinyl acetal resilient torsion control spring joint connection; at least one plastic resilient torsion control spring joint connection; at least one flexible PVC resilient torsion control spring joint connection; and at least one composite resilient torsion control spring joint connection.

16. An improved animal roping system as described in claim 1 wherein said resilient torsion control joint connection comprises a resilient torsion control shaped extension joint connection.

17. An improved animal roping system as described in claim 16 wherein said resilient torsion control joint connection comprises a resilient torsion control shaped extension joint connection selected from the group consisting of: at least one polyurethane resilient torsion control shaped extension joint connection; and at least one ethel vinyl acetal (EVA) resilient torsion control shaped extension joint connection; at least one plastic resilient torsion control shaped extension joint connection; at least one flexible PVC resilient torsion control shaped extension joint connection; and at least one composite resilient torsion control shaped extension joint connection.

18. An improved animal roping system as described in claim 1 wherein said resilient torsion control joint connection comprises at least one distal resilient torsion control joint projection.

19. An improved animal roping system as described in claim 1 wherein said resilient torsion control joint connection comprises at least one torsion control coupling.

20. An improved animal roping system as described in claim 1 wherein said resilient torsion control joint connection comprises at least one tension lock washer.

21. An improved animal roping system as described in claim 1 wherein said resilient torsion control joint connection comprises a plurality of resilient torsion control joint connections having differential torque characteristics.

22. An improved animal roping system as described in claim 14 wherein said resilient torsion control spring joint connection comprises least one resilient torsion control spring joint connection having differential torque characteristics selected from the group consisting of: at least one variable coil strength resilient torsion control spring joint connection; at least one variable coil size resilient torsion control spring joint connection; at least one variable coil length resilient torsion control spring joint connection; at least one variable coil pitch resilient torsion control spring joint connection; at least one variable coil diameter resilient torsion control spring joint connection; at least one variable active coil resilient torsion control spring joint connection; at least one variable spring constant resilient torsion control spring joint connection; and at least one variable coil number resilient torsion control spring joint connection.

23. An improved animal roping system as described in claim 1 wherein said resilient torsion control joint connection comprises at least one pre-loaded resilient torsion control joint connection.

* * * * *